United States Patent [19]

Agrawal et al.

[11] Patent Number: 4,662,918

[45] Date of Patent: May 5, 1987

[54] AIR SEPARATION PROCESS

[75] Inventors: Rakesh Agrawal; Thomas E. Cormier, Sr., both of Allentown, Pa.

[73] Assignee: Air Products and Chemicals, Inc., Allentown, Pa.

[21] Appl. No.: 869,144

[22] Filed: May 30, 1986

[51] Int. Cl.[4] ..... F25J 5/00

[52] U.S. Cl. ..... 62/13; 62/18; 62/39; 62/43

[58] Field of Search ..... 62/11, 13, 31, 38, 39, 62/43, 18

[56] References Cited

U.S. PATENT DOCUMENTS

| | | | |
|---|---|---|---|
| 2,627,731 | 2/1953 | Benedict | 62/34 |
| 2,982,108 | 5/1961 | Grunberg et al. | 62/28 |
| 3,492,828 | 2/1970 | Ruckborn | 62/13 |
| 3,736,762 | 6/1973 | Toyama et al. | 62/13 |
| 4,222,756 | 9/1980 | Thorogood | 62/13 |
| 4,303,428 | 12/1981 | Vandenbussche | 62/38 |
| 4,400,188 | 8/1983 | Patel et al. | 62/13 |
| 4,410,343 | 10/1983 | Ziemer | 62/43 |
| 4,464,188 | 8/1984 | Agrawal et al. | 62/13 |

*Primary Examiner*—Ronald C. Capossela

*Attorney, Agent, or Firm*—Willard Jones, II; James C. Simmons; E. Eugene Innis

[57] ABSTRACT

A process is set forth for the separation of air by cryogenic distillation in a single column to produce a nitrogen product and an oxygen-enriched product. In the process, at least a portion of the nitrogen product is compressed and recycled to provide reboil at the bottom of the distillation column and to provide some additional reflux to the upper portion of the column. In addition, part of the compressed nitrogen recycle stream is expanded to provide work.

15 Claims, 3 Drawing Figures

AIR SEPARATION PROCESS

TECHNICAL FIELD

The present invention is directed to the separation of air into its constituents, nitrogen and oxygen. Specifically, the invention is directed to the cryogenic distillation of air to produce a nitrogen product and an oxygen-enriched product.

BACKGROUND OF THE PRIOR ART

The prior art has recognized the need to perform air separation, particularly for the recovery of nitrogen with greater efficiency. With the increasing cost of energy and the need for large quantities of separated gas such as nitrogen for enhanced petroleum recovery, highly efficient separation processes and apparatus are necessary to provide competitive systems for the separation and production of the components of air, most particularly nitrogen.

In U.S. Pat. No. 2,627,731 a process for the rectification of air into oxygen and nitrogen is described wherein a two sectioned or single distilation column are used alternatively. Air is cooled by heat exchange and introduced directly into the distillation column. A nitrogen product is removed from the overhead of the column and a portion is compressed in two stages. The first stage nitrogen compressed stream is recycled in order to reboil and condense a portion of the midpoint of the column by indirect heat exchange before being introduced into the overhead of the column as reflux. A second stage compressed nitrogen stream is recycled and partially expanded to provide refrigeration. This expanded stream is recycled to the nitrogen product line. The remaining stream of the second stage compressed nitrogen stream reboils the bottom of the column before being combined with the first stage compressed nitrogen stream and introduced into the overhead of the column as reflux.

In U.S. Pat. No. 2,982,108, an oxygen producing air separation system is set forth wherein a portion of the nitrogen generated from the distillation column is compressed and reboils the base of a high pressure section of the column before being introduced as reflux to the low pressure section of the column. The feed air stream is supplied in separate substreams into the high pressure section of the column and in an expanded form into the low pressure section of the column.

U.S. Pat. No. 3,492,828 discloses a process for the production of oxygen and nitrogen from air wherein a nitrogen recycle stream is compressed and condensed in a reboiler in the base of a distillation column before being reintroduced into the column as reflux. A portion of the nitrogen recycle stream may be expanded in which the power provided by the expansion drives the compressor for the main nitrogen recycle stream.

In U.S. Pat. No. 3,736,762, a process for producing nitrogen in gaseous and liquefied form from air is set forth. A single distillation column is refluxed with nitrogen product condensed in an overhead condenser operated by the reboil of oxygen conveyed from the bottom of said column. At least a portion of the oxygen from the overhead condenser is expanded to produce refrigeration for the separation.

In U.S. Pat. No. 4,222,756, a process is set forth in which a two pressure distillation column is used in which both pressurized column sections are refluxed with an oxygen-enriched stream. The low pressure column is fed by a nitrogen-enriched stream from the high pressure column which is expanded to reduce its pressure and temperature.

U.S. Pat. No. 4,400,188 discloses a nitrogen production process wherein a single nitrogen recycle stream refluxes a distillation column which is fed by a single air feed. Waste oxygen from the column is expanded to provide a portion of the necessary refrigeration.

In U.S. Pat. No. 4,464,188 a process and apparatus is set forth for the separation of air by cryogenic distillation in a rectification column using two nitrogen recycle streams and a sidestream of the feed air stream to reboil the column. One of the nitrogen recycle streams is expanded to provide refrigeration and to provide power to compress the feed air sidestream.

Although the prior art has taught numerous systems for the separation of air and particularly the production of a nitrogen product from air, these systems have been unable to achieve the desired efficiencies in power consumption and product recovered which are necessary in the production of large volumes of air components, such as nitrogen.

BRIEF SUMMARY OF THE INVENTION

The present invention is directed to a system for the separation of air by cryogenic distillation in a single distillation column which comprises compressing a feed air stream to an elevated pressure and aftercooling the pressurized air stream. Water and carbon dioxide are removed, preferably in a molecular sieve unit, from the pressurized air stream to prevent freezing during the process. The feed air stream is cooled against warming process product streams prior to being introduced into an intermediate location of the distillation column. A nitrogen product stream and an oxygen-enriched stream are separated in and removed from said distillation column. A portion of the nitrogen product stream is condensed against the oxygen-enriched stream and is returned to the column as reflux. The remaining nitrogen product stream is rewarmed by heat exchange against process streams and at least a portion of the product stream is compressed to an elevated pressure. The compressed nitrogen product stream is split into three substreams. The first nitrogen product substream is compressed. Part of the first substream is removed as nitrogen product and the remainder is cooled against process streams, expanded and reunited with the third substream to form a combined substream. This combined stream is used to reboil the distillation column, at a location above the bottom of the column, before being reduced in pressure and introduced into the column as reflux. The second nitrogen product substream is further compressed, cooled against warming product streams, and used to reboil the bottom of the column before being reduced in pressure and introduced into the column as reflux. The third substream is cooled against warming product streams, reunited with the first substream prior to reboiling the column with the combined substreams.

Two variations on the above scheme are possible. In the first variation, the first substream after expansion is, instead of reunited with the third substream, used to reboil the distillation column in a third reboiler before reducing it further in pressure and introducing it into the column as reflux. In this scheme, the third substream is used to reboil the column in a reboiler located between the reboiler of the second substream and the reboiler of the first substream.

In the second variation, two nitrogen product substreams are split off instead of three. A first nitrogen product substream further compressed. Part of the first substream is removed as nitrogen product; the remainder is cooled against process streams, expanded, further cooled and used to reboil the distillation column, at a location above the bottom of the column before being reduced in pressure and introduced into the column as reflux. The second nitrogen product substream is compressed, cooled against warming product streams and used to reboil the bottom of the column before being reduced in pressure and introduced into the column as reflux.

Preferably, in all of the above described configurations, the oxygen-enriched stream from the bottom of the distillation column is flashed through a JT valve before introduction into the outer shell of the condenser of the distillation column in order to reduce its temperature and pressure. Additionally, the oxygen-enriched product stream can be used to reactivate the molecular sieve dryer.

Advantageously, the molecular sieve dryer is comprised of a pair of switching adsorption beds in which both beds are packed with a molecular sieve material and used alternately for adsorption and regeneration.

BRIEF DESCRIPTION OF THE DRAWING

In FIGS. 1–3, common stream and equipment numbers are retained.

DETAILED DESCRIPTION OF THE INVENTION

Figure 1:
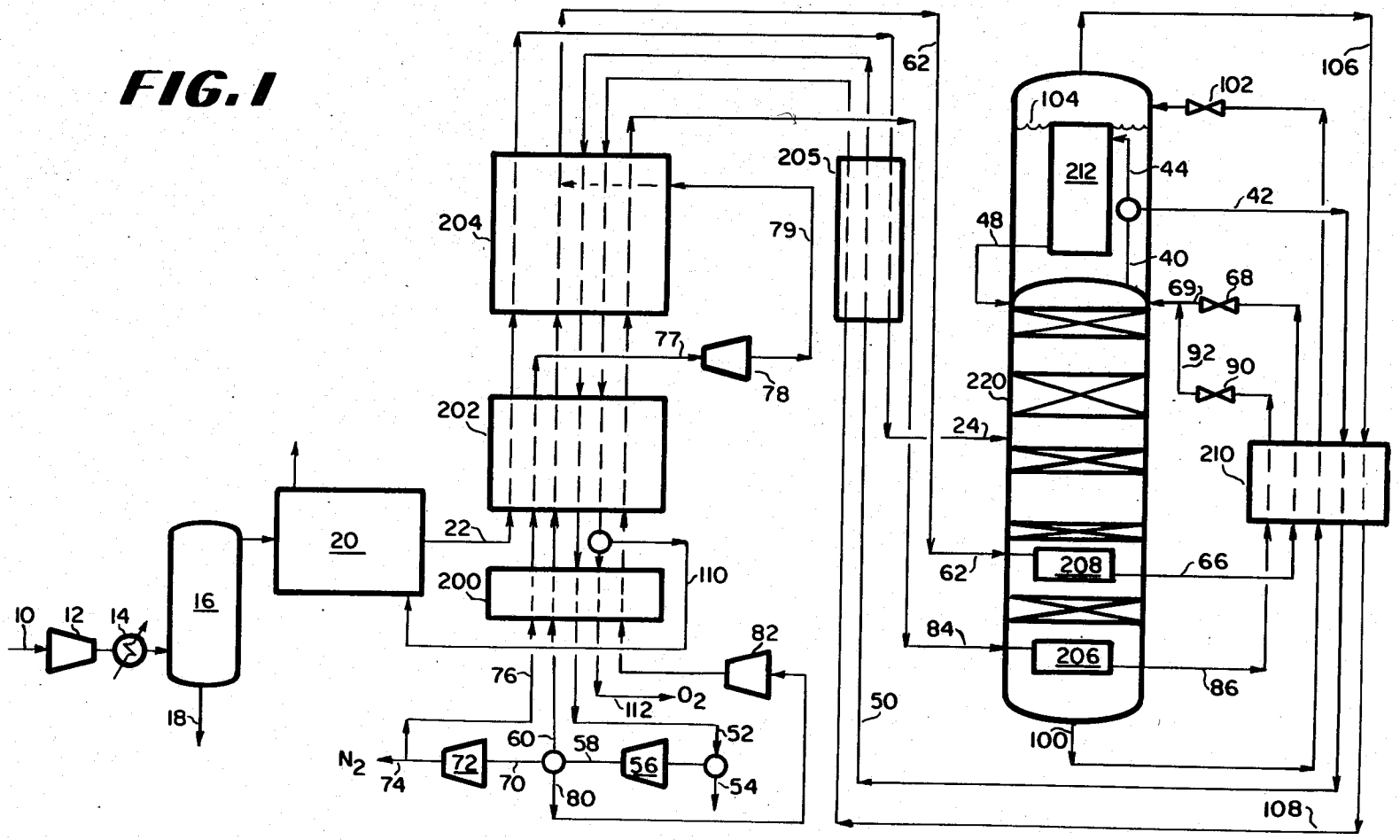
FIG. 1 is a schematic flow scheme of a preferred embodiment of the present invention.

The present invention will now be described in greater detail with respect to a preferred embodiment of the invention and two variations of it. With reference to FIG. 1, a feed air stream is introduced into the system in line 10 and is compressed to an elevated pressure in the main air compressor 12. The heat of compression is removed from the air stream by heat exchange against an external cooling fluid, such as water at ambient conditions, in heat exchanger or aftercooler 14. The high pressure aftercooled feed air stream is then introduced into a knock-out drum 16 wherein condensed water and other heavy components, such as hydrocarbons, are removed as a liquid phase in drain line 18. Most of the condensables are removed in this apparatus, but residual moisture and carbon dioxide are still entrained in the feed air stream. To remove the residual water and carbon dioxide, the feed air stream is directed through a molecular sieve bed 20. The molecular sieve bed is preferably a pair of adsorption beds which are packed with a molecular sieve adsorbent. While one bed is in the adsorption stage removing water and carbon dioxide from the feed air stream, the other bed is in a regeneration stage in which a dry regeneration gas, preferably a process stream, such as a waste oxygen-enriched stream, is passed through the regenerating adsorption bed to remove adsorbed water and carbon dioxide. The duty on the beds is switched in a timed sequence corresponding to the adsorption capacity of the beds. Such an apparatus is generally referred to as a dryer and is known in the art specifically as switching adsorption beds.

The compressed and dried feed air stream in line 22 is then cooled by heat exchange in heat exchangers 202, 204 and 205 against process streams and introduced, via line 24, into a single pressure distillation column 220 at an intermediate level.

An oxygen-enriched stream is removed from the bottom of the column 220 in line 100. This stream contains approximately 50 to 80% oxygen depending upon the overall nitrogen recovery of the system. The oxygen-enriched stream in line 100 is further cooled in subcooling heat exchanger 210 before being flashed to a reduced temperature and pressure through JT valve 102 and introduced into the sump outside the column condenser 212. The oxygen-enriched phase 104 in heat exchange with the condenser 212 is reboiled against a nitrogen product removed from the top of the column in line 40. A nitrogen product stream is removed from the top of the column in line 42, while a nitrogen reflux stream is directed in line 44 through the condenser 212 to be condensed against the reboiling oxygen-enriched phase 104 and reintroduced into distillation column 220 by line 48 as a reflux stream for distillation column 220.

The vapor phase of the oxygen-enriched phase 104 in the overhead of distillation column 220 is removed in line 106 and rewarmed against process streams in subcooling heat exchanger 210. The warmed oxygen-enriched stream in line 108 is then further rewarmed against process streams in heat exchanger 205, 204, 202 and 200. A portion of the oxygen-enriched stream is removed before passage through heat exchanger 200 in line 110 and is used to regenerate the dryer 20, specifically, the regeneration of the molecular sieve bed presently in the regeneration stage. This gas, the oxygen-enriched stream, is essentially free of water and carbon dioxide and readily desorbs such components from the adsorbent material in the bed during the regeneration sequence. The spent regeneration gas may then be vented or used for utility requiring oxygen enrichment where water and carbon dioxide do not present a problem. The remaining oxygen-enriched stream passes through heat exchanger 200 and is further rewarmed before leaving the system in line 112. Again, the oxygen-enriched stream in line 112 may be used for utilities requiring oxygen-enrichment, and this stream is also free of water and carbon dioxide. Alternately, the stream may be vented to atmosphere.

The nitrogen product stream removed from stream 40 in line 42 contains essentially pure nitrogen which is rewarmed in subcooling heat exchanger 210 against process streams. The nitrogen product stream now in line 50 is further rewarmed by heat exchange against process streams in heat exchanger 205, 204, 202 and 200. The nitrogen product stream now in line 52 can be used in part for reactivation or for a product at low pressure by removing a stream in line 54. The remaining portion of the nitrogen product stream in line 52 is then compressed to an intermediate elevated pressure in compressor 56. The intermediate pressure level nitrogen product stream in line 58 is then split into three nitrogen substreams 60, 80, and 70.

The first substream is further compressed in compressor 72 and is then a product stream, via line 74, is split off. The remaining portion of the substream, in line 70, is cooled by heat exchange against process streams in heat exchangers 200 and 202 and emerges as stream 77. This first cooled substream 77 is then expanded in expander 78 to produce work for refrigeration and compression. The exhaust from expander 78, line 79, is is united with the third substream and further cooled in exchanger 204 prior to be introduced to reboiler 208 in line 62.

The second nitrogen substream in line 80 is further compressed in compressor 82 and is then cooled by heat exchange against process streams in heat exchangers 200, 202 and 204 and emerges as stream 84. The second nitrogen substream in line 84 is then introduced into the recycle reboiler 206 situated in the lowest portion of distillation column 220. The substream is condensed in the reboiler 206 as the substream heat exchanges with the bottoms liquid which is reboiled to send vapors upward through the column. The condensed substream is removed from the reboiler 206 in line 86 and is further cooled in subcooling heat exchanger 210 before being flashed through a JT valve 90 to a lower temperature and pressure before being merged with the combined substream in line 69 and introduced into the top of distillation column 220.

The third substream in line 60 is cooled by heat exchange against process streams in heat exchangers 200, 202 and 204 and is reunited with the remaining portion of the first nitrogen substream, now in line 79, this combined substream emerges as stream 62. The combined substream in line 62 is then introduced into the recycle reboiler 208 situated in the lower portion of distillation column 220, above reboiler 206. The substream is condensed in the reboiler 208 as the substream heat exchanges with the liquid in distillation column 220 and some of which is reboiled to send vapors upward through the column. The condensed combined substream is removed from the reboiler 208 in line 66 and is further cooled in subcooling heat exchanger 210 before being flashed through a JT valve 68 to a lower temperature and pressure before being merged with the substream in line 92 and introduced into the top of distillation column 220 as reflux.

Although not shown, a liquid stream may be withdrawn from the condenser 212 and passed through a guard adsorber to prevent hydrocarbon buildup. This stream then would pass through a heat pump and reenter the condenser 212. A small liquid purge would also be taken off the condenser 212 for the same purpose.

This process is particularly attractive because it utilizes expansion of a part of the pressurized nitrogen stream to provide both refrigeration and compression. Efficient utilization of the power derived from this expansion is realized by the use of the expander generated power in the compressor of the nitrogen recycle substream 70. The expander 78 and the compressor 82 can be interconnected in any known manner, such as by an electrical connection between an expander power generator and an electric motor driven compressor, or preferably by the mechanical linkage of the expander to the compressor in what is known in the art as a compander. This provides particularly efficient utilization of the power provided in the expander in the compression of the nitrogen in the compressor 82. The present invention will now be further described with reference to an example of air separation for the recovery of nitrogen gas at high pressure.

Figure 2:
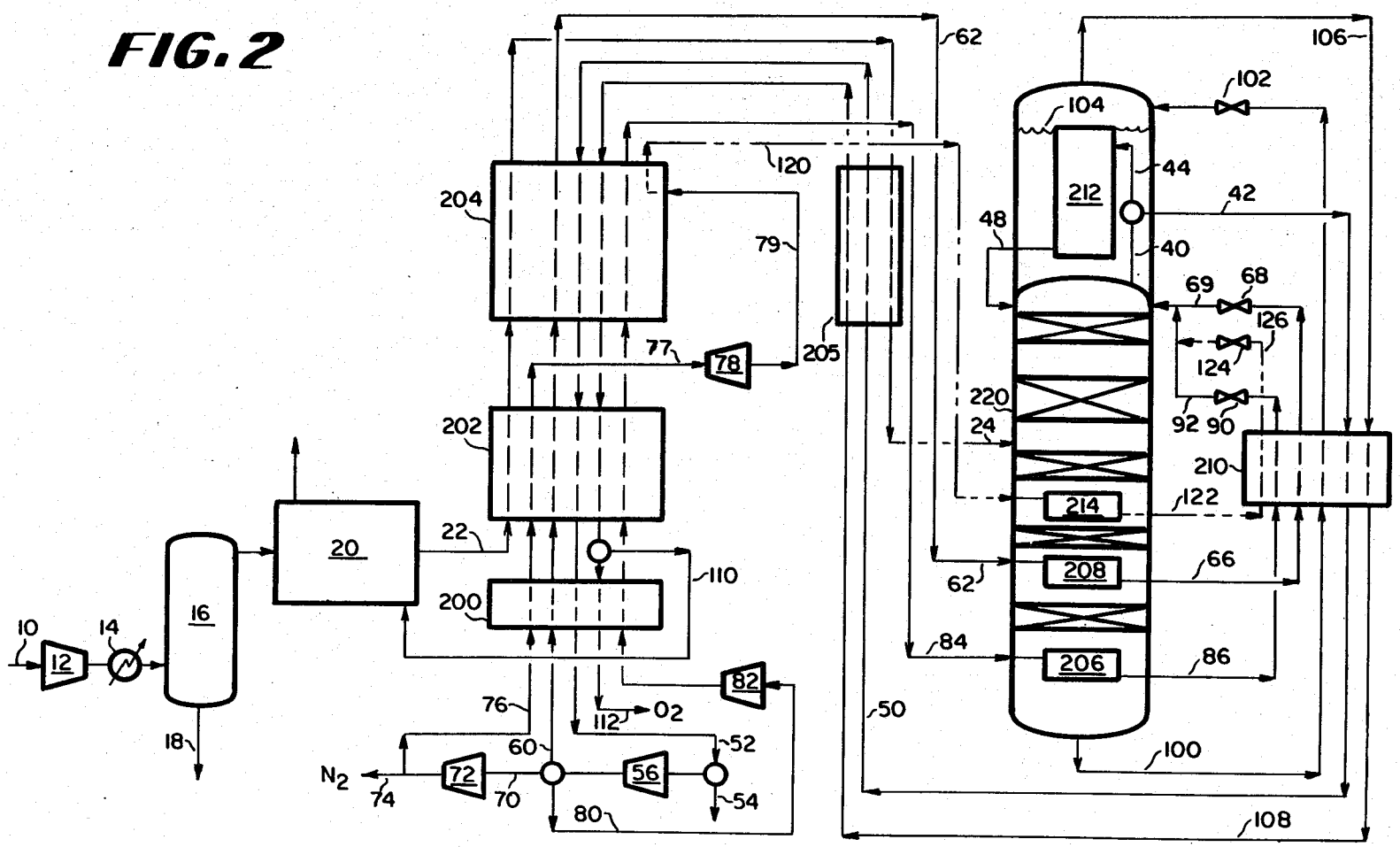
FIG. 2 is a schematic flow scheme of a first alternative to the preferred embodiment of the present invention.
Figure 3:
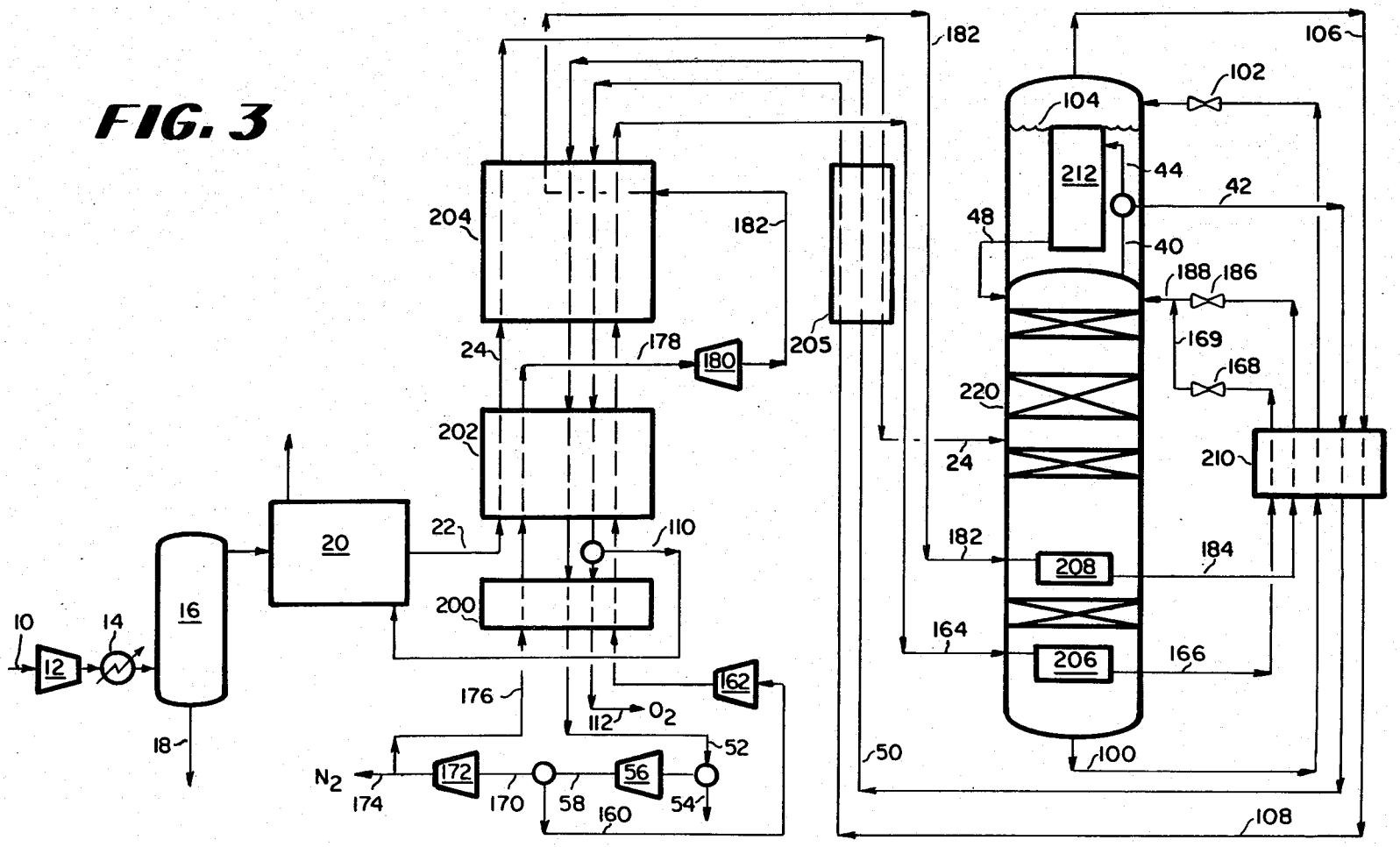
FIG. 3 is a schematic flow scheme of a second alternative to the preferred embodiment of the present invention.

Two variations on the above preferred embodiment are shown in FIG. 2 and FIG. 3. In FIG. 2, the first nitrogen substream in line 79 is not reunited with the second nitrogen substream to form stream 62. The first nitrogen substream in line 79 is cooled in heat exchange against process streams and is then introduced, via line 120, into the recycle reboiler 214 situated in a lower portion of distillation column 220, above reboiler 208. The first substream is condensed in the reboiler 214 as the substream heat exchanges with the liquid in distillation column 220 which is reboiled to send vapors upward through the column. The condensed substream is removed from the reboiler 214 in line 122 and is further cooled in subcooling heat exchanger 210 before being flashed through a JT valve 124 to a lower temperature and pressure before being merged with the second substream in line 69 and the second substream in line 92 and introduced into the top of distillation column 220 as reflux. The remainder of the process is the same as that depicted in FIG. 1.

In FIG. 3, the intermediate pressure level nitrogen product stream in line 58 is split into two nitrogen substreams 160 and 170. The second nitrogen substream in line 160 is further compressed in compressor 162 and is then cooled by heat exchange against process streams in heat exchangers 200, 202 and 204 and emerges as stream 164. The second nitrogen substream in line 164 is then introduced into the recycle reboiler 206 situated in the lowest portion of distillation column 220. The substream is condensed in the reboiler 206 as the substream heat exchanges with the bottoms liquid which is reboiled to send vapors upward through the column. The condensed substream is removed from the reboiler 206 in line 166 and is further cooled in subcooling heat exchanger 210 before being flashed through a JT valve 168 to a lower temperature and pressure before being merged with the combined substream in line 188 and introduced into the top of distillation column 220 as reflux.

The first substream 170 is further compressed in compressor 172 and is then a product stream, via line 174, is split off. The remaining portion of the substream is cooled by heat exchange against process streams in heat exchangers 200 and 202 and emerges as stream 178. This first cooled substream 178 is then expanded in expander 180 to produce work for refrigeration and compression. The exhaust from expander 180, line 182, is further cooled in exchanger 204 and is introduced to reboiler 208 in line 182. The first substream in line 182 is then introduced into the recycle reboiler 208 situated in the lower portion of distillation column 220, above reboiler 206. The substream is condensed in the reboiler 208 as the substream heat exchanges with the liquid in distillation column 220 which is reboiled to send vapors upward through the column. The condensed first substream is removed from the reboiler 208 in line 184 and is further cooled in subcooling heat exchanger 210 before being flashed through a JT valve 186 to a lower temperature and pressure before being merged with the substream in line 169 introduced into the top of distillation column 220 as reflux. The remainder of the process is the same as that depicted in FIG. 1.

The present invention will now be further described with reference to an example of air separation for the recovery of nitrogen gas at high pressure.

EXAMPLE

With reference to the preferred embodiment, FIG. 1, a feed air stream is introduced in line 10 into the air separation apparatus and compressed and aftercooled to a pressure of about 66 psia and a temperature of 25° C. The feed air after drying is passed through the heat exchangers 202, 204 and 205 and cooled to a temperature of −168° C. before being introduced, in line 24, as feed into distillation column 220 for rectification at a pressure of about 62 psia.

An oxygen-enriched stream containing 76% oxygen is removed, in line 100, from the base of the column, is cooled, reduced in pressure and introduced into the overhead of the column outside the shell of the overhead condenser to condense a nitrogen reflux stream. The enriched liquid, line 104, is at approximately −182° C. Gaseous oxygen is then removed in line 106. A pure nitrogen product having 2 ppm of oxygen is removed in line 42 and is rewarmed before being compressed at 56 to about 150 psia. About 3% of the product is recycled in line 80, 15% recycled in line 70, and 28% recycled in line 60, while the remaining nitrogen product is removed from the system, via line 74. Nitrogen substream 70 is compressed in compressor 72 to a pressure of 360 psia. The substream is further cooled in exchangers 200 and 202 to a temperature of about −104° C. The cooled nitrogen substream is expanded in expander 76 to a pressure of 148 psia and is combined with nitrogen substream 60. The combined stream is cooled in heat exchanger 204 to about −166° C. This combined substream is then used to reboil the column while being condensed and leaves the reboiler at about −169° C. It is cooled in exchanger 210 and introduced into column 220 along with substream 80 at approximately −181° C. Nitrogen substream 80 is compressed in compressor 82 to 167 psia, then cooled in exchangers 200, 202 and 204 to −166° C. and introduced into and condensed in reboiler 206. This stream is cooled in exchanger 210 before entering column 220. The nitrogen product is further compressed to a pressure of 213 psia, this portion is not shown in the firgures. The system, as run, provides gaseous nitrogen at pressure, approximately 213 psia, and recovers approximately 93% of the total nitrogen processed by the system. The energy consumption used by the process of the present invention is about 0.221 $KWH/NM^3$.

The present invention has been set forth with regard to a specific preferred embodiment, but those skilled in the art will recognize obvious variations which are deemed to be within the scope of the invention, which scope should be ascertained from the claims which follow.

We claim:

1. A process for the separation of air by cryogenic distillation of the air in a distillation column comprising the steps of:

(a) compressing a feed air stream to an elevated pressure and aftercooling the pressurized air stream;

(b) removing water and carbon dioxide, preferably in a molecular sieve unit, from the pressurized air stream;

(c) cooling the feed air stream against warming process product streams prior to introducing the feed air stream to the distillation column;

(d) introducing the feed air stream into an intermediate location of the distillation column;

(e) separating a nitrogen product stream and an oxygen-enriched stream from said distillation column;

(f) condensing a portion of the nitrogen product stream against the oxygen-enriched stream and returning it to the column as reflux;

(g) rewarming the remaining nitrogen product stream by heat exchange against process streams and compressing at least a portion of the product stream to an intermediate elevated pressure;

(h) splitting the compressed nitrogen product stream into three substreams;

(i) compressing a first nitrogen product substream further, removing part of the first substream as nitrogen product and cooling the remainder against process streams, expanding the remaining first substream in an expander, further cooling the remaining first substream, reuniting the remaining first substream with the third substream to form a combined substream, and reboiling the distillation column, at a location above the bottom of the column, with the combined substream before reducing it in pressure and introducing it into the column as reflux;

(j) further compressing a second nitrogen product substream, cooling the compressed second substream against warming product streams, and reboiling the bottom of the column with the second substream before reducing it in pressure and introducing it into the column as reflux; and (k) cooling the third substream against warming product streams, reuniting the third substream with the first substream prior to reboiling the column with the combined substreams.

2. The process of claim 1 wherein the oxygen-enriched stream is removed from the column condenser and rewarmed in heat exchange against process streams.

3. The process of claim 1 wherein the feed air stream is passed through a molecular sieve adsorbent bed to remove residual water and carbon dioxide.

4. The process of claim 3 wherein at least part of the oxygen enriched product stream is used to regenerate the molecular sieve adsorbent bed.

5. The process of claim 1 wherein the oxygen-enriched stream is removed from the bottom of the distillation column, cooled by heat exchange against process streams and then reduced in temperature and pressure before being supplied to the condenser of the distillation column.

6. A process for the separation of air by cryogenic distillation of the air in a distillation column comprising the steps of:

(a) compressing a feed air stream to an elevated pressure and aftercooling the pressurized air stream;

(b) removing water and carbon dioxide, preferably in a molecular sieve unit, from the pressurized air stream;

(c) cooling the feed air stream against warming process product streams prior to introducing the feed air stream to the distillation column;

(d) introducing the feed air stream into an intermediate location of the distillation column;

(e) separating a nitrogen product stream and an oxygen-enriched stream from said distillation column;

(f) condensing a portion of the nitrogen product stream against the oxygen-enriched stream and returning it to the column as reflux;

(g) rewarming the remaining nitrogen product stream by heat exchange against process streams and compressing at least a portion of the product stream to an intermediate elevated pressure;

(h) splitting the compressed nitrogen product stream into three substreams;

(i) compressing a first nitrogen product substream further, removing part of the first substream as nitrogen product and cooling the remainder against process streams, expanding the remaining first substream in an expander, further cooling the remaining first substream and reboiling the distillation column, at a location above the bottom of the column, with the first substream before reducing it in pressure and introducing it into the column as reflux;

(j) further compressing a second nitrogen product substream, cooling the compressed second substream against warming product streams, and reboiling the bottom of the column with the second substream before reducing it in pressure and introducing it into the column as reflux; and (k) cooling the third substream against warming product streams and reboiling the distillation column, at the bottom of the column, with the third substream before reducing it in pressure and introducing it into the column as reflux.

7. The process of claim 6 wherein the oxygen-enriched stream is removed from the column condenser and rewarmed in heat exchange against process streams.

8. The process of claim 6 wherein the feed air stream is passed through a molecular sieve adsorbent bed to remove residual water and carbon dioxide.

9. The process of claim 8 wherein at least part of the oxygen enriched product stream is used to regenerate the molecular sieve adsorbent bed.

10. The process of claim 6 wherein the oxygen-enriched stream is removed from the bottom of the distillation column, cooled by heat exchange against process streams and then reduced in temperature and pressure before being supplied to the condenser of the distillation column.

11. A process for the separation of air by cryogenic distillation of the air in a distillation column comprising the steps of:

(a) compressing a feed air stream to an elevated pressure and aftercooling the pressurized air stream;

(b) removing water and carbon dioxide, preferably in a molecular sieve unit, from the pressurized air stream;

(c) cooling the feed air stream against warming process product streams prior to introducing the feed air stream to the distillation column;

(d) introducing the feed air stream into an intermediate location of the distillation column;

(e) separating a nitrogen product stream and an oxygen-enriched stream from said distillation column;

(f) condensing a portion of the nitrogen product stream against the oxygen-enriched stream and returning it to the column as reflux;

(g) rewarming the remaining nitrogen product stream by heat exchange against process streams and compressing at least a portion of the product stream to an intermediate elevated pressure;

(h) splitting the compressed nitrogen product stream into two substreams;

(i) compressing a first nitrogen product substream further, removing part of the first substream as nitrogen product and cooling the remainer against process streams, expanding the remaining first substream in an expander, further cooling the remainding first substream, and reboiling the distillation column, at a location above the bottom of the column, with the remaining first substream before reducing it in pressure and introducing it into the column as reflux; and (j) further compressing a second nitrogen product substream, cooling the compressed second substream against warming product streams, and reboiling the bottom of the column with the second substream before reducing it in pressure and introducing it into the column as reflux.

12. The process of claim 11 wherein the oxygen-enriched stream is removed from the column condenser and rewarmed in heat exchange against process streams.

13. The process of claim 11 wherein the feed air stream is passed through a molecular sieve adsorbent bed to remove residual water and carbon dioxide.

14. The process of claim 13 wherein at least part of the oxygen enriched product stream is used to regenerate the molecular sieve adsorbent bed.

15. The process of claim 11 wherein the oxygen-enriched stream is removed from the bottom of the distillation column, cooled by heat exchange against process streams and then reduced in temperature and pressure before being supplied to the condenser of the distillation column.

* * * * *